US011564460B2

(12) United States Patent
Garda et al.

(10) Patent No.: US 11,564,460 B2
(45) Date of Patent: Jan. 31, 2023

(54) KEY-RING

(71) Applicant: Garda & Co. S.r.l., Sant'Ambrogio (IT)

(72) Inventors: Elena Garda, Sant'Ambrogio (IT); Stefano Garda, Sant'Ambrogio (IT); Marco Garda, Sant'Ambrogio (IT)

(73) Assignee: GARDA & CO. S.R.L., Sant'Ambrogio (IT)

( * ) Notice: Subject to any disclaimer, the term of this patent is extended or adjusted under 35 U.S.C. 154(b) by 0 days.

(21) Appl. No.: 17/029,616

(22) Filed: Sep. 23, 2020

(65) Prior Publication Data

US 2021/0085037 A1 Mar. 25, 2021

(30) Foreign Application Priority Data

Sep. 24, 2019 (IT) ..... 102019000017078

(51) Int. Cl.
*A44B 15/00* (2006.01)

(52) U.S. Cl.
CPC ..... *A44B 15/002* (2013.01)

(58) Field of Classification Search
CPC ... A44B 15/002; A44B 15/00; Y10T 70/8676; Y10T 70/8757; Y10T 24/1379
See application file for complete search history.

(56) References Cited

U.S. PATENT DOCUMENTS 2,877,640 A * 3/1959 Anderson ..... A44B 15/00 24/598.2
4,422,315 A * 12/1983 Klose ..... A44B 15/002 70/456 R
4,425,772 A * 1/1984 Brewer ..... G09F 3/08 70/456 R
6,845,644 B1 * 1/2005 Buckner ..... A44B 15/00 24/598.2
D666,407 S * 9/2012 Schoultz ..... D3/207
8,262,393 B2 * 9/2012 Adams ..... A44C 23/00 434/246
8,464,564 B2 * 6/2013 Von Shoultz ..... A44B 15/00 24/600.9
9,474,335 B2 * 10/2016 Heller ..... A44B 15/002
9,854,879 B2 * 1/2018 Barr ..... A44B 15/00
9,925,116 B2 * 3/2018 Miceli ..... A61J 1/1437
10,085,522 B1 * 10/2018 Huang ..... A44B 15/002
D836,906 S * 1/2019 Benson ..... D3/207
10,178,896 B1 * 1/2019 Huang ..... A45F 5/022
(Continued)

FOREIGN PATENT DOCUMENTS

CH 686604 A5 5/1996
CN 106723694 A 5/2017
(Continued)

OTHER PUBLICATIONS

Italian Search Report dated May 11, 2020.

*Primary Examiner* — Victor D Batson
*Assistant Examiner* — Matthew J Sullivan
(74) *Attorney, Agent, or Firm* — Heslin Rothenberg Farley & Mesiti P.C.; Victor A. Cardona, Esq.

(57) ABSTRACT

A key-ring included a first and a second ring slidably mounted relative to each other in a circumferential direction. The key-ring includes mutual engagement members configured to define a reference for an open ring configuration and/or a closed ring configuration.

13 Claims, 9 Drawing Sheets

(56) References Cited

U.S. PATENT DOCUMENTS

Figure 1:
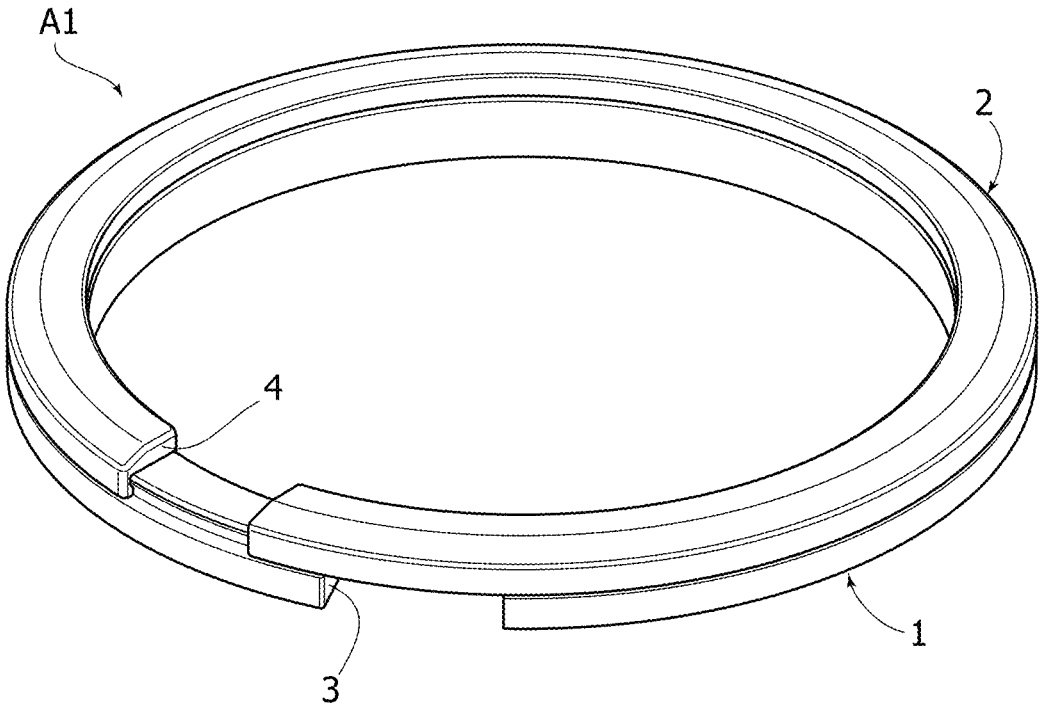

| | | | | |
|---|---|---|---|---|
| 10,449,064 | B2 * | 10/2019 | Wrobel | A61F 2/90 |
| 10,492,571 | B2 * | 12/2019 | Barr | E05B 19/00 |
| 10,808,429 | B2 * | 10/2020 | Smith | E05B 73/0005 |
| 10,989,058 | B2 * | 4/2021 | Trivedi | F16J 15/3272 |
| 2008/0209966 | A1 * | 9/2008 | Howard | A44B 15/002 70/459 |
| 2018/0092441 | A1 * | 4/2018 | Barr | A44B 15/00 |

FOREIGN PATENT DOCUMENTS

| | | | |
|---|---|---|---|
| DE | 202012010777 | U1 | 2/2013 |
| WO | 2010017645 | A1 | 2/2010 |

* cited by examiner

KEY-RING

CROSS REFERENCE TO RELATED APPLICATIONS

This application claims priority from Italian Patent Application No. 102019000017078 filed on Sep. 24, 2019, the entire disclosure of which is incorporated herein by reference.

FIELD OF THE INVENTION

The present invention relates to a key-ring arranged to group a plurality of keys and, for example, an ornamental pendant with a decorative function.

OBJECT OF THE INVENTION

The object of the present invention is to make a key-ring available which has a structure that is constructively simple, of low bulk, and that has a low production cost.

A second object of the present invention is to produce a key-ring that is extremely practical and simple to use, while at the same time allowing the objects engaged therein to be stored with maximum safety.

SUMMARY OF THE INVENTION

With a view to achieving these objects, the key-ring according to the invention comprises a first and a second ring slidably mounted on each other along the circumferential direction, wherein each of said first and second rings includes a respective open sector so that said first and second rings are movable on each other between an open ring configuration wherein said open sectors are aligned, and a closed ring configuration wherein said open sectors are offset relative to each other, said key-ring further including mutual engagement members configured to define a reference of at least one of said configurations.

According to a first embodiment, said mutual engagement members can include:

- a spring extending within a seat formed along a portion of said upper wall of the first ring, and
- a bar portion projecting from the lower wall of the second ring and arranged within said seat on the prolongation of said spring, said bar portion being slidable within said seat, so as to cooperate with said spring.

The aforesaid seat has a first end wall in contact with the spring and a second end wall in contact with the bar portion, in such a way that, in a resting condition of the ring, said bar portion is in abutment against the second end wall, and said spring acts against the sliding of the bar portion within the seat, stably defining said closed loop configuration. In the event that either said first or second ring is rotated to achieve the open ring configuration, the aforesaid spring tends to push the bar portion against the second end wall of said seat, recalling the ring into the closed ring configuration.

According to a second embodiment, the mutual engagement members include a toothing obtained along the lower wall of the second ring, arranged to cooperate with a pair of elastic tabs arranged within a groove obtained along an upper wall of the first ring.

The toothing and the elastic tabs are configured to allow the sliding of either the first or the second ring with respect to the other in one direction only, and to lock the key-ring both in the open ring configuration and in the closed ring configuration.

According to a third embodiment, the first ring has a C-shaped cross-section, so as to define an inner wall within which the second ring is slidably arranged. The mutual engagement members may include a pressing member carried by the second ring, configured to cooperate with a seat arranged at a portion of the first ring.

DETAILED DESCRIPTION OF DIFFERENT EMBODIMENTS

Figure 2:
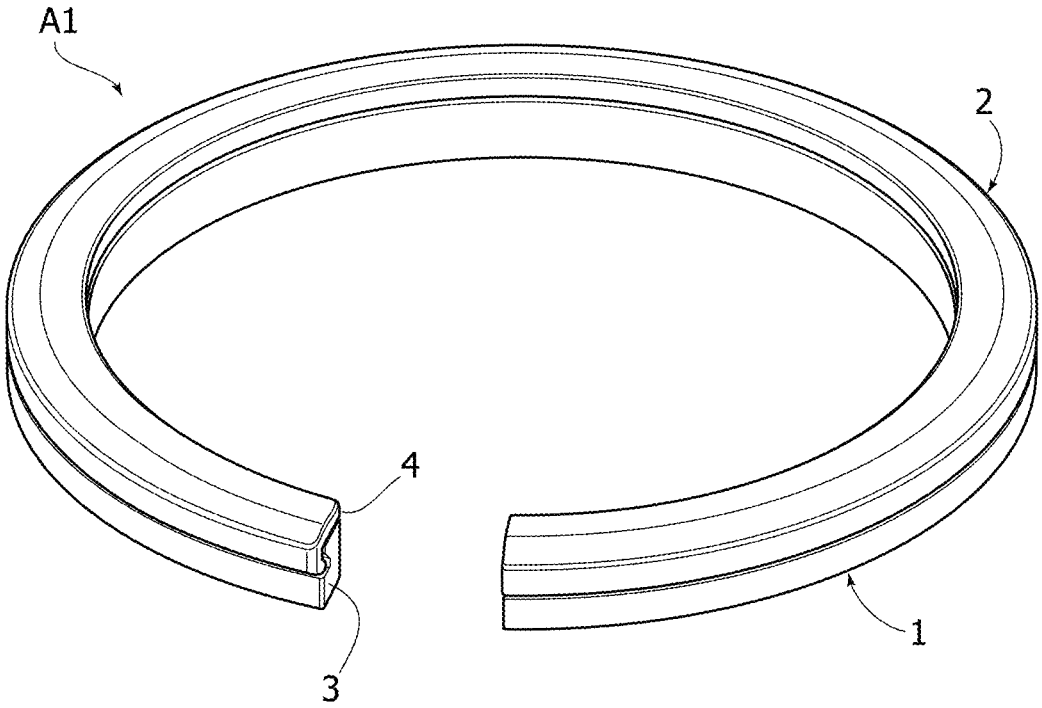
Figure 3:
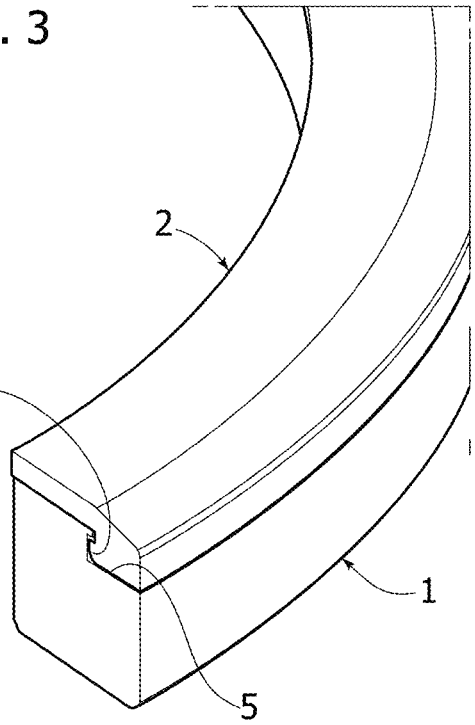
Figure 4:
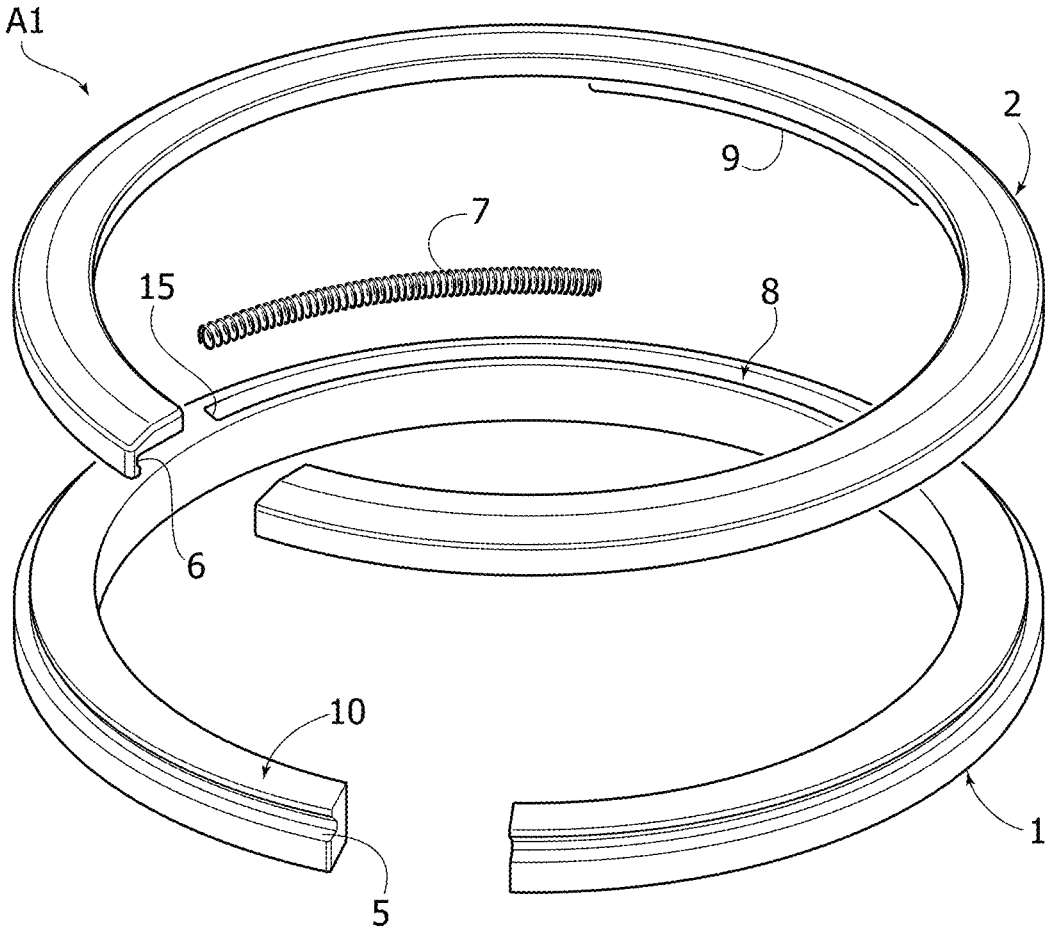
Figure 5:
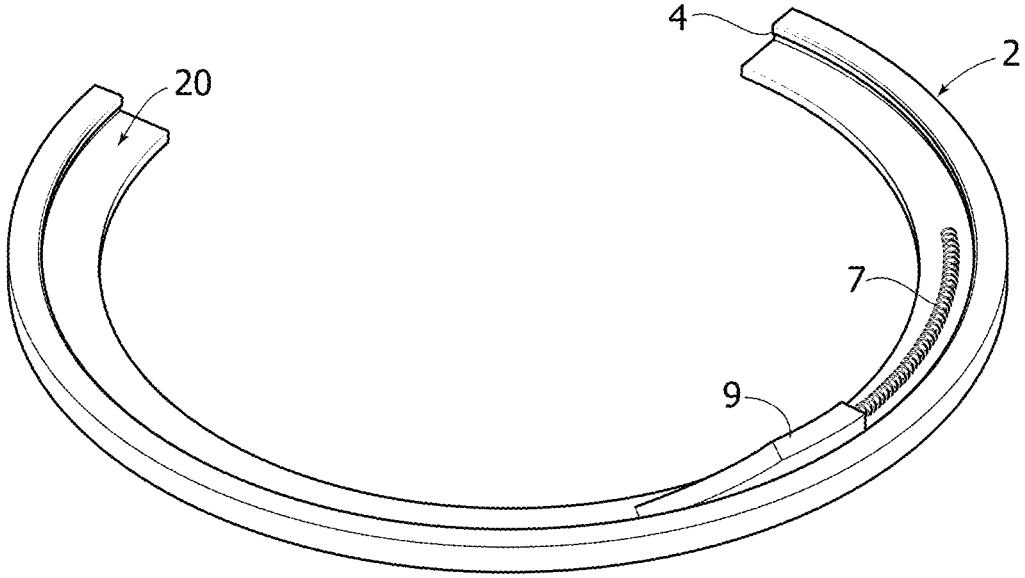
Figure 6:
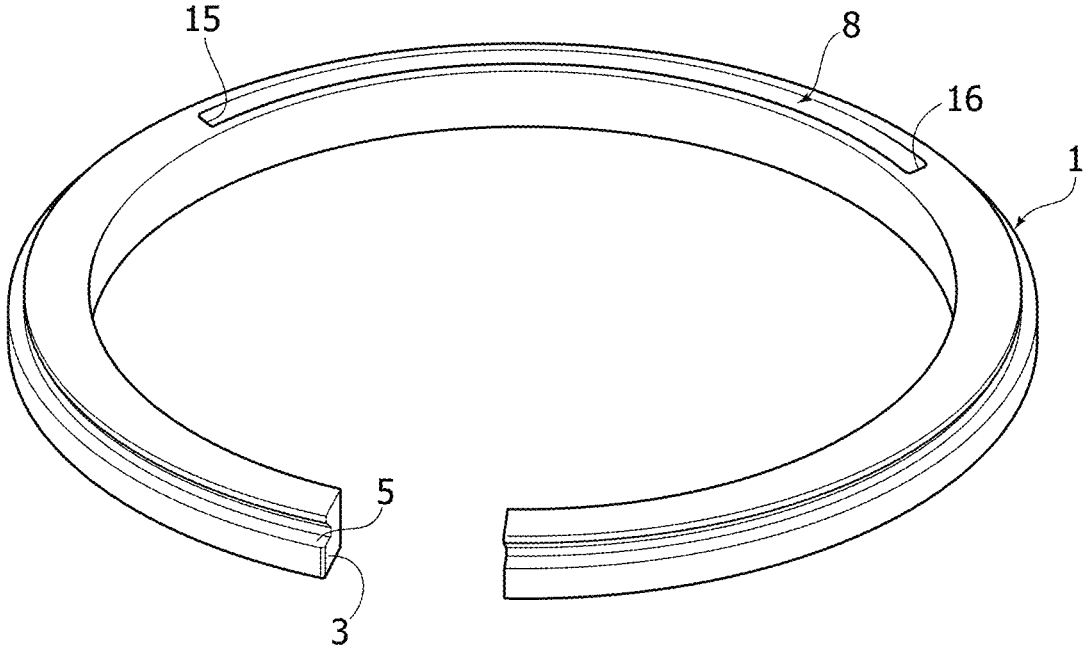
Figure 7:
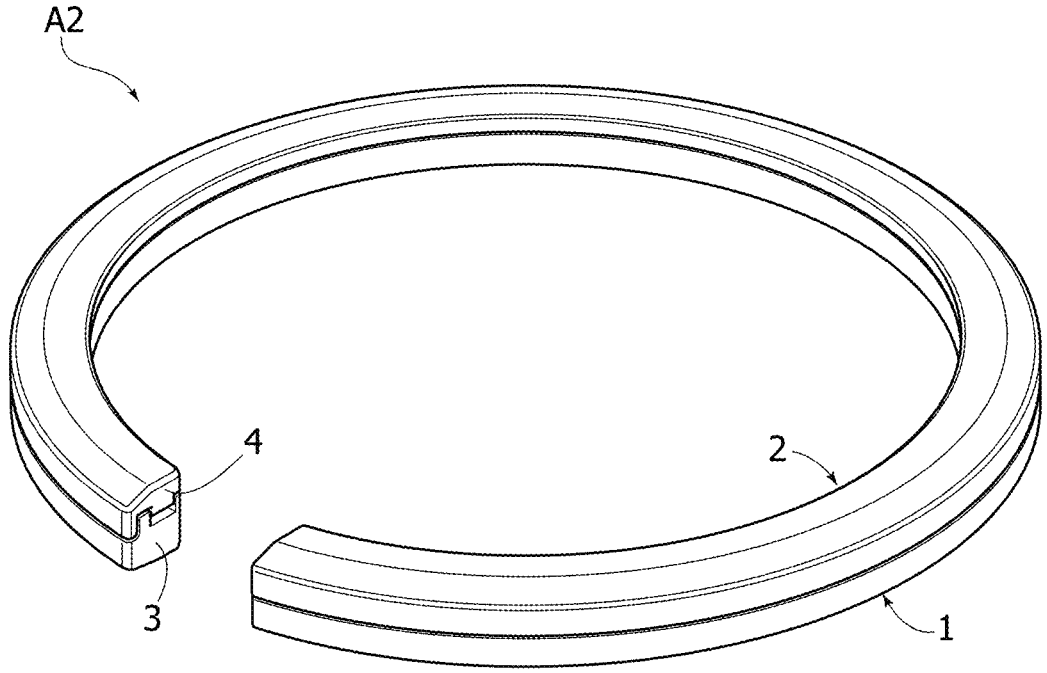
Figure 8:
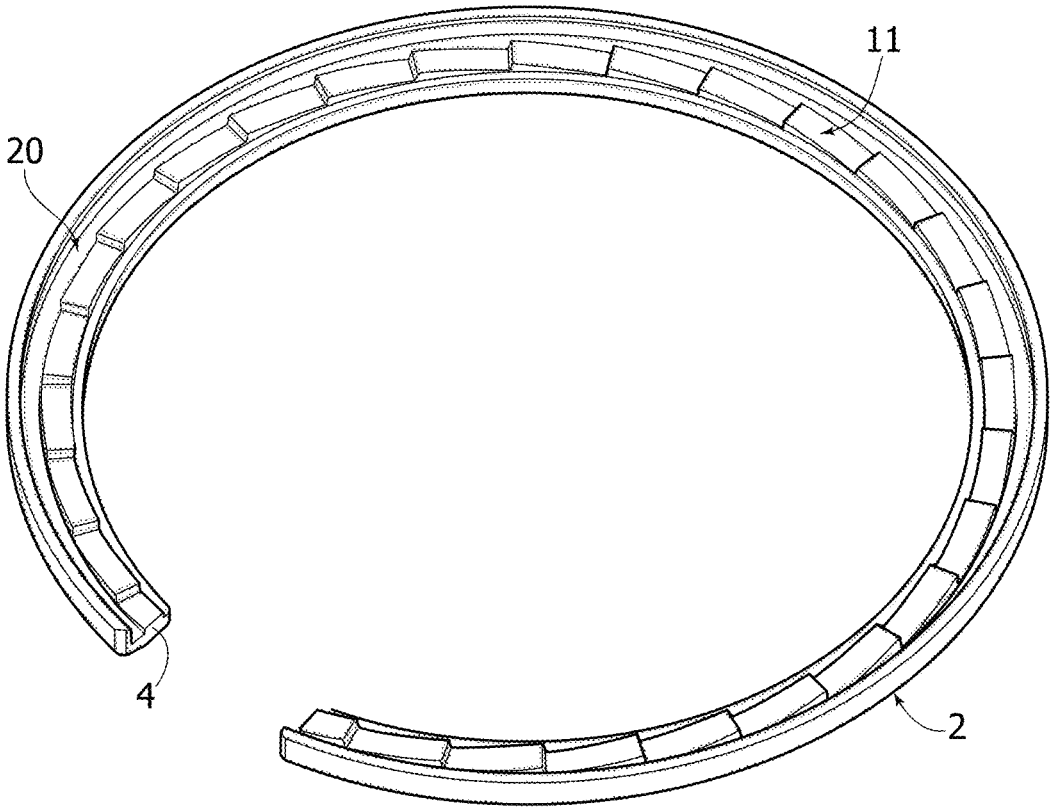
Figure 9:
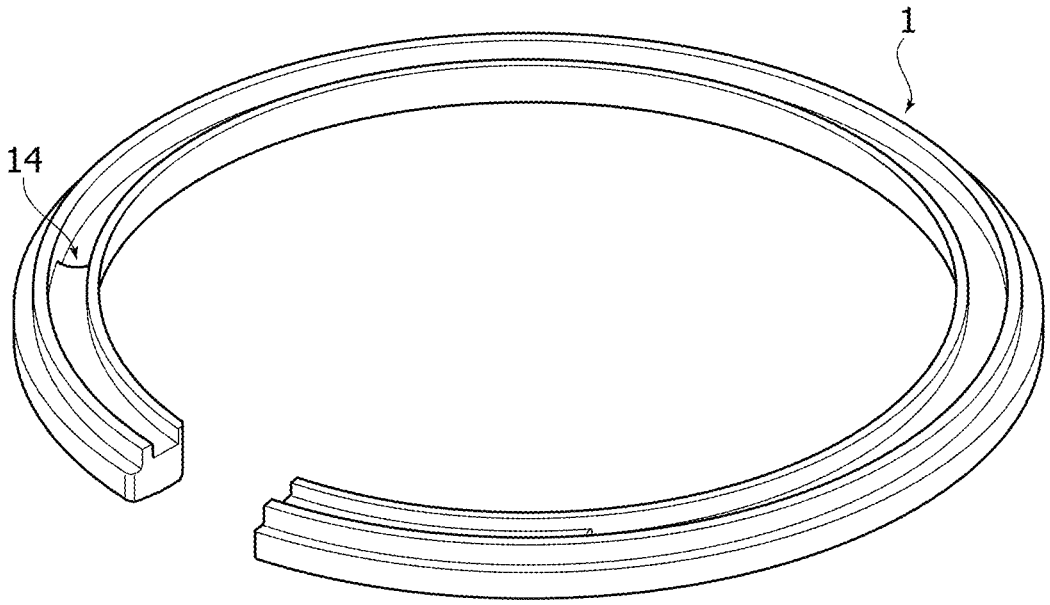
Figure 10:
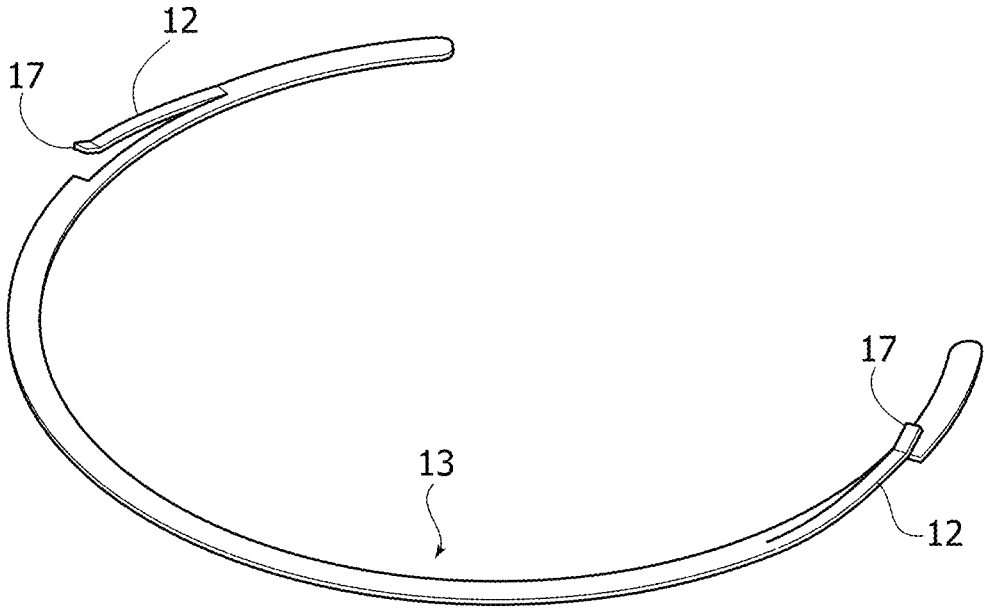
Figure 11:
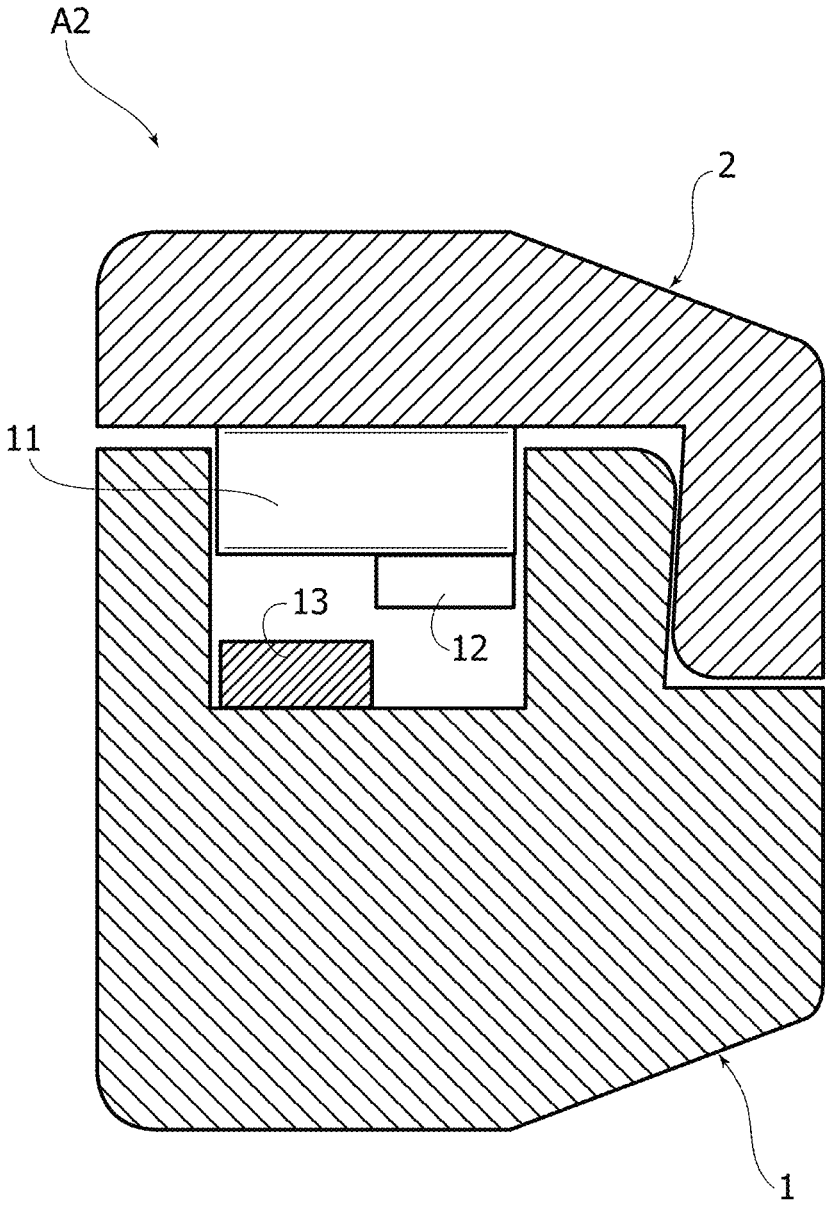
Figure 12:
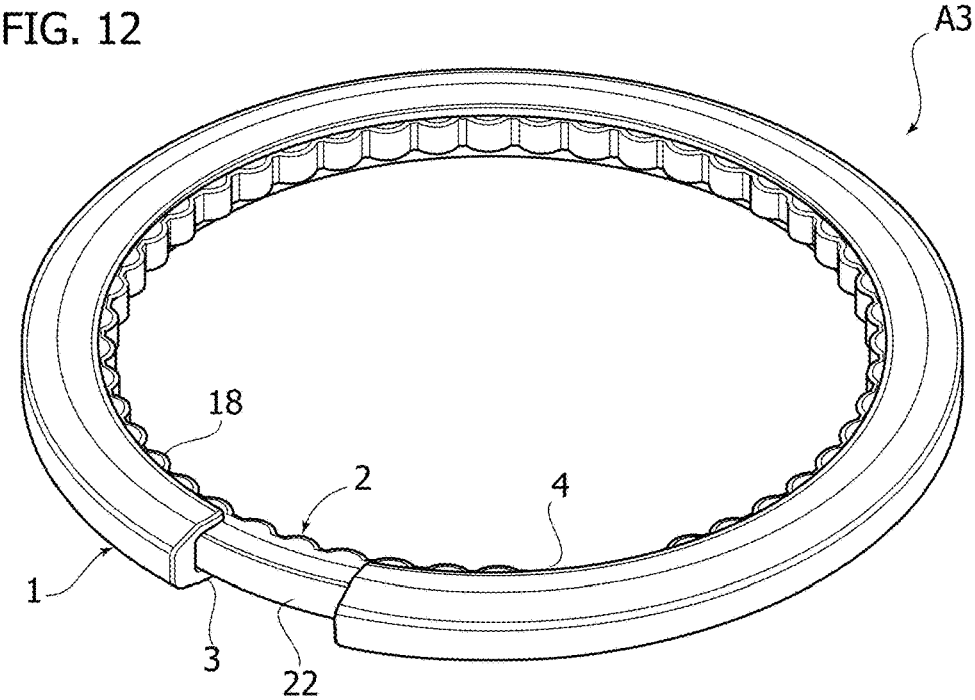
Figure 13:
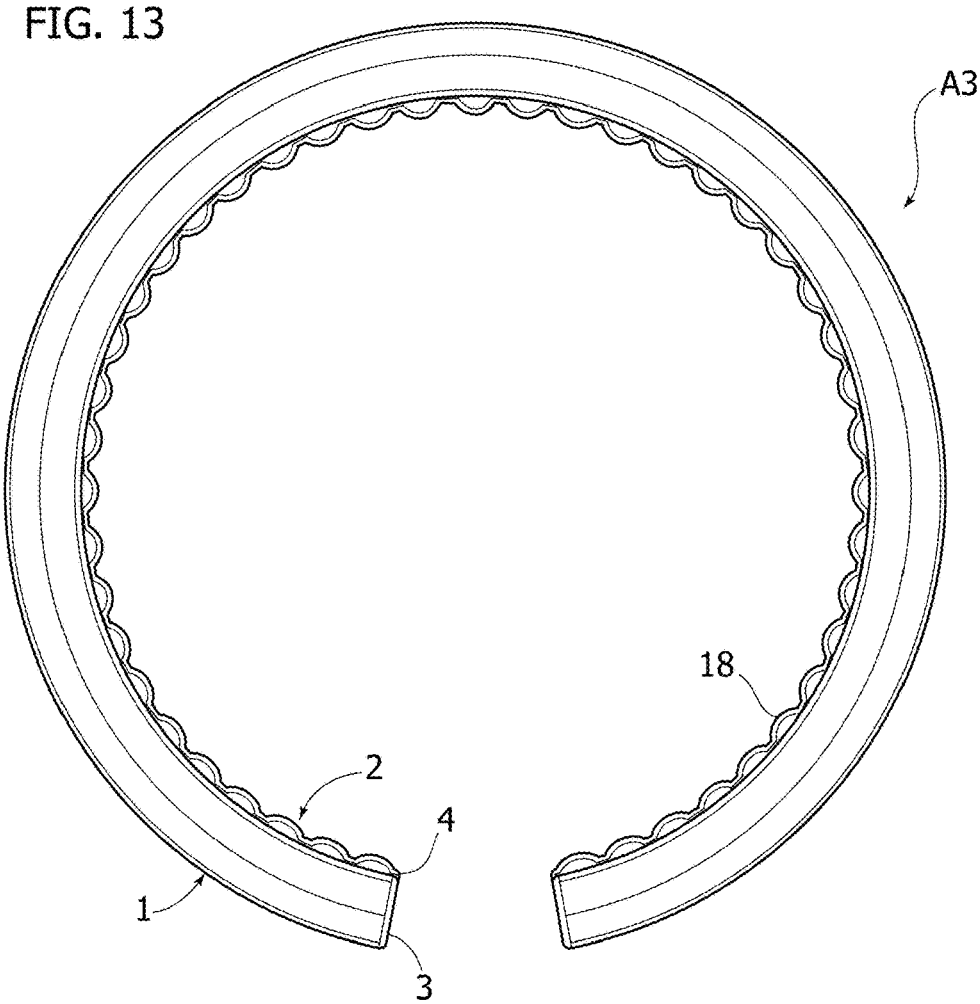
Figure 14A:
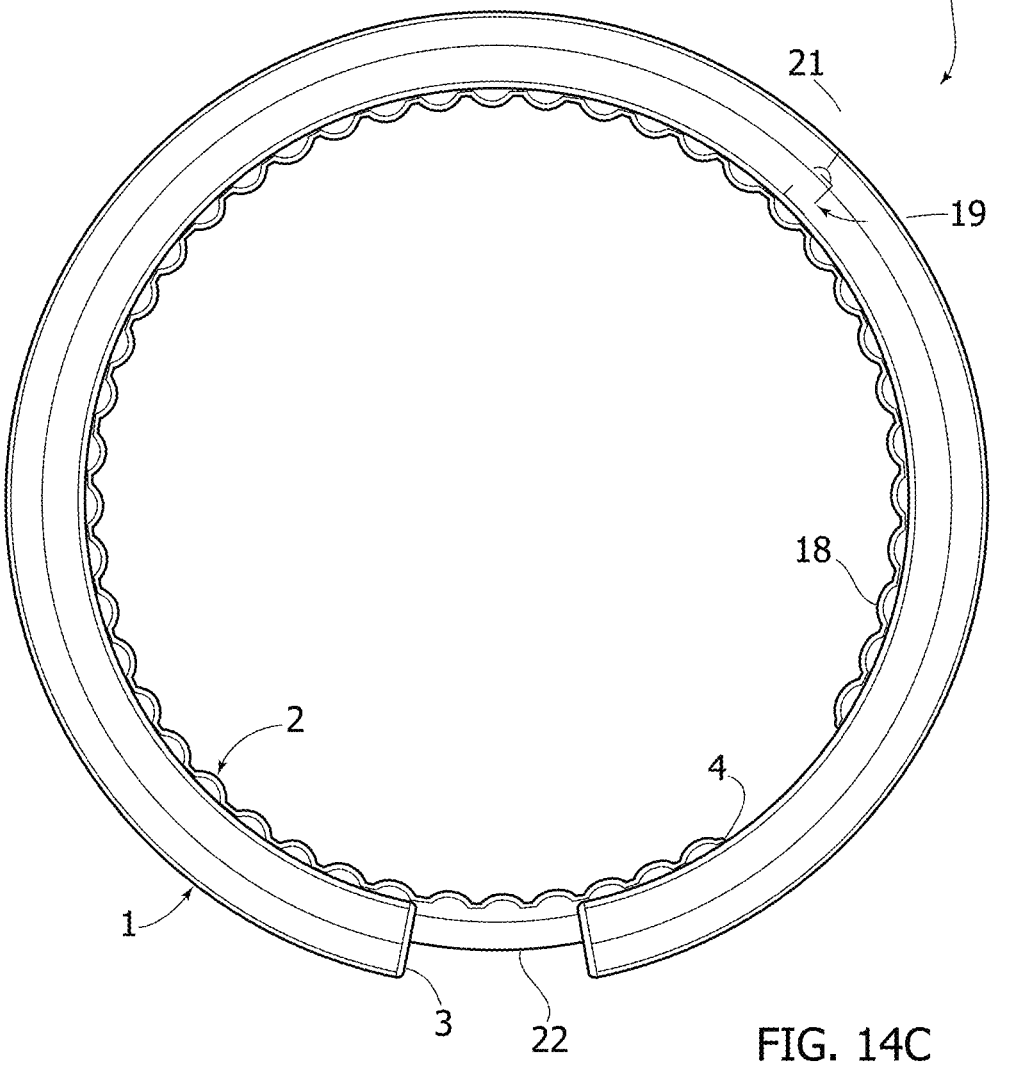
Figure 14B:
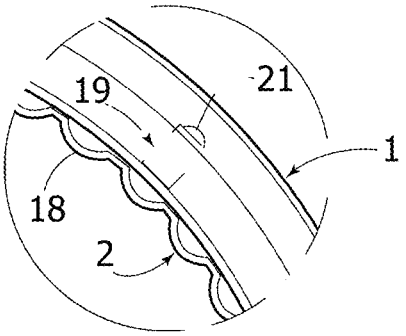
Figure 14C:
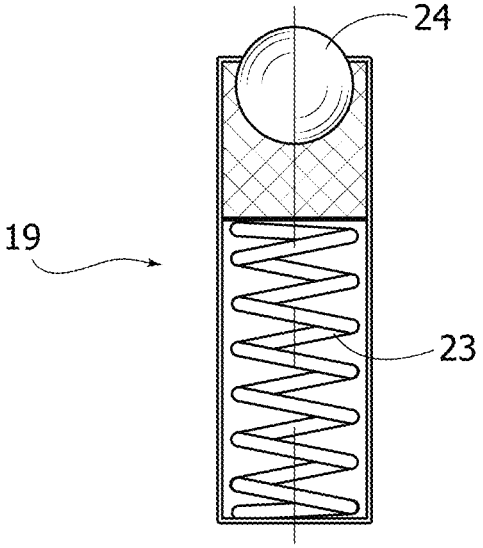
Figure 15:
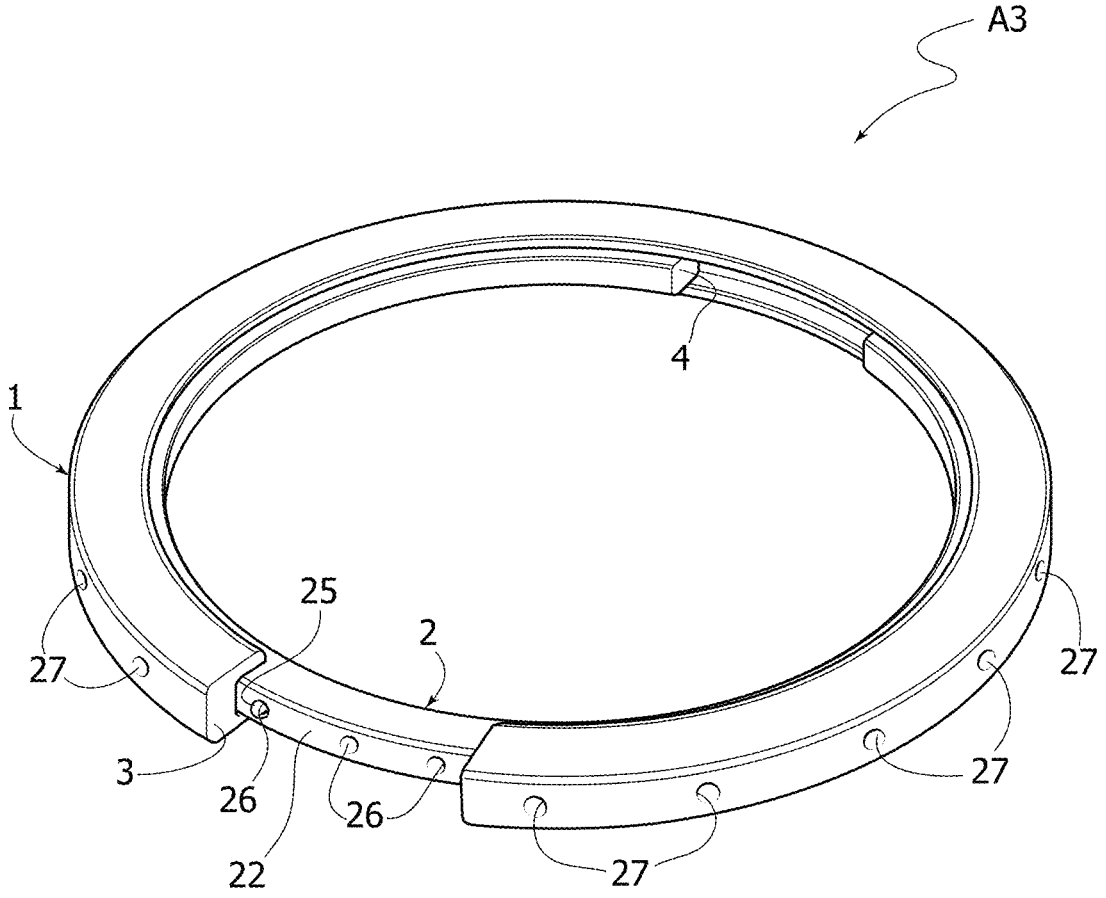

The invention will now be described in detail with reference to the attached drawings, provided purely by way of non-limiting example, wherein:

FIGS. 1 and 2 are two perspective views of a key-ring according to a first embodiment, illustrated in different operating positions, FIG. 3 is a view on an enlarged scale of some details illustrated in FIG. 2, FIG. 4 is an exploded perspective view of the key-ring shown in the previous figures, FIGS. 5 and 6 are perspective views that illustrate some details of FIG. 4, FIG. 7 is a perspective view of a key-ring according to a second embodiment, FIGS. 8-10 are perspective views of some details of the key-ring illustrated in FIG. 7, FIG. 11 is a cross-sectional view of the key-ring shown in FIG. 7, FIGS. 12 and 13 are two perspective views of a key-ring according to a third embodiment, illustrated in different operating positions, FIG. 14A is an elevated perspective view of the key-ring illustrated in FIGS. 12 and 13, FIGS. 14B and 14C are views on an enlarged scale of some details illustrated in FIG. 14A, and FIG. 15 is a perspective view of a further embodiment of the invention.

In the following description various specific details are illustrated aimed at a thorough understanding of examples of one or more embodiments. The embodiments can be implemented without one or more of the specific details, or with other methods, components, materials, etc. In other cases, known structures, materials, or operations are not shown or described in detail to avoid obscuring various aspects of the embodiments. The reference to "an embodiment" in the context of this description indicates that a particular configuration, structure or characteristic described in relation to the embodiment is included in at least one embodiment. Therefore, phrases such as "in an embodiment", possibly present in different places of this description do not necessarily refer to the same embodiment. Moreover, particular conformations, structures or characteristics can be combined in a suitable manner in one or more embodiments and/or associated with the embodiments in a different way from that illustrated here, for example, a characteristic here exemplified in relation to a figure may be applied to one or more embodiments exemplified in a different figure.

The references illustrated here are only for convenience and do not, therefore, delimit the field of protection or the scope of the embodiments.

Preferred embodiments of a key-ring A1, A2, A3 according to the present invention are illustrated in the attached drawings.

The key-ring A1, A2, A3 comprises a first ring 1 and a second ring 2 slidably mounted and adjacent relative to each other along their circumference.

In one or more embodiments, the first and second rings 1, 2 are slidably mounted and axially superimposed relative to each other.

In one or more embodiments, the first and second rings 1, 2 are slidably mounted and radially superimposed relative to each other.

As illustrated in particular in FIGS. 1, 2, 7, 13, 15, the first and second rings 1, 2 include a respective open sector 3, 4, arranged to allow the insertion and attachment of keys or other objects (for example, a decorative pendant) to the key-ring A1, A2, A3.

According to an essential feature of the present invention, the key-ring A1, A2, A3 includes mutual engagement members configured to lock the key-ring A1, A2, A3 in an open ring configuration (FIGS. 2, 7 and 13), wherein the open sectors 3, 4 of the first and second rings 1, 2 are superimposed, or a closed loop configuration (FIGS. 1, 12, 15) wherein the aforesaid open sectors 3, 4 are offset with respect to each other.

Below, it will be described in greater detail how these mutual engagement members can be made.

With reference to the embodiment illustrated in FIGS. 1-6, the key-ring A1 comprises first and second rings 1, 2 slidably mounted and axially superimposed relative to each other. The first ring 1 has an upper wall 10 coupled with a lower wall 20 of the second ring 2. To allow the stable coupling between the first and the second ring 1,2, the upper wall 10 of the first ring 1 has a grooved portion 5 extending along the circumference of the ring A1, configured to cooperate with a corresponding tooth portion 6 obtained on the lower wall 20 of the second ring 2 (FIGS. 3 and 4).

The mutual engagement members configured to define a reference for ring configurations include:

- a spring 7 spaced within a seat 8 formed along a portion of the upper wall 10 of the first ring 1, and
- a bar portion 9 protruding from the lower wall 20 of the second ring 2 and arranged within the seat 8 on the extension of the spring 7. The bar portion 9 slides within the seat 8 so as to cooperate with the spring 7 (FIGS. 4-6).

The seat 8 includes a first end wall 15 in contact with the spring 7 and a second end wall 16 in contact with one end of the bar portion 9 opposite the spring 7.

It will therefore be appreciated that, in accordance with the engagement members described above, in a resting condition of the ring A1, the bar portion 9 abuts against the second end wall 16 of the seat 8 and the spring 7 acts against the sliding of the bar portion 9 within the seat 8, stably defining the aforesaid closed loop configuration (illustrated in FIG. 1).

In the event that either the first or second ring 1, 2 is rotated with respect to the other to achieve the open loop configuration (FIG. 2), the ring A1 tends to return to the resting condition defining the closed loop configuration. More particularly, by rotating the second ring 2 with respect to the first ring 1, the spring 7 compresses and tends to push the bar portion 9 against the second end wall 16 of the seat 8, thus recalling the ring A1 into the resting condition defining the closed loop configuration.

As illustrated, in particular, in the perspective view of FIG. 5, the bar portion 9 can be made in a trapezoidal shape. Of course, the bar portion 9 can be made with different shapes and dimensions with respect to what is illustrated in the drawings.

Thanks to the mutual engagement members as described above, it is possible to maintain the closed loop configuration in a stable manner, thus allowing the objects engaged therein to be safely stored within the ring A1.

In the following part of the present description, a second preferred embodiment of the key-ring A2 according to the present invention will now be described in detail (FIGS. 7-11).

As indicated above, the key-ring A2 comprises a first and a second ring 1, 2 slidably mounted and axially superimposed relative to each other, wherein each of the rings 1, 2 includes a respective open sector 3, 4. In this embodiment (FIGS. 7-11) as well, the key-ring A2 includes mutual engagement members configured to stably define an open ring configuration, wherein the open sectors 3,4 are superimposed, or a closed ring configuration, wherein the open sectors 3,4 are offset from each other.

However, unlike the embodiment described above (FIGS. 1-6), in this case, the mutual engagement members are configured to stably define multiple ring configurations, so as to be able to arrange the first ring 1 with respect to the second ring 2 (and therefore the two open sectors 3,4) in any position along the circumference of the ring A2.

According to that illustrated in FIGS. 8-11, the mutual engagement members include a toothing 11 obtained along the lower wall 20 of the second ring 2 (FIG. 8), configured to cooperate with a pair of elastic tabs 12 (FIG. 10) arranged within a groove 14 formed along the upper wall 10 of the first ring 1 (FIG. 9).

The toothing 11 has a plurality of ratchet-guided teeth with surfaces inclined in the same direction, while the elastic tabs 12 are formed on an open intermediate ring 13 arranged within the aforesaid groove 14 (FIG. 11). More specifically, the elastic tabs 12 are inclined portions of the intermediate ring 13, obtained in symmetrical positions along the circumference of the intermediate ring 13. Each elastic tab 12 has an inclined main body protruding from the groove 14 in the direction of the toothing 11. The inclined main body includes a first end connected to the flat body of the intermediate ring 13, and an opposite end 17 further inclined towards the teeth of the toothing 11. It will therefore be appreciated that, thanks to the conformation of the elastic tabs 12, and their inclination in two opposite directions so as to cooperate correctly with the toothing 11, the rotation of either the first or the second ring 1, 2, with respect to the other, can only take place in one direction, since in the opposite direction the ends 17 of the tabs 12 block the sliding of the teeth inclined above them. The locking between the first and second rings 1, 2 can take place according to any arrangement of the two rings 1, 2, at the engagement between the elastic tabs 12 and any pair of inclined teeth.

In the following part of the present description, a further preferred embodiment of the key-ring A3 according to the present invention will now be described in detail (FIGS. 12-14C). In this embodiment, the key-ring A3 comprises first and second rings 1, 2 slidably mounted and radially superimposed relative to each other. In this case as well, the first and second rings 1, 2 each have a respective open sector 3, 4 and are slidably mounted relative to each other in the circumferential direction.

The first ring 1 has a C-shaped cross-section, so as to define an inner wall within which the second ring 2 is slidably arranged. The second ring 2 has an outer wall 22 in contact with the inner wall of the first ring 1. It will therefore be appreciated that the first and second rings 1, 2 are provided side by side relative to each other.

Preferably, the second ring 2 has an inner wall 18 with a ridged profile, so as to facilitate the grip of a user on the inner wall 18, to rotate the second ring 2 with respect to the first ring 1.

According to that illustrated in FIGS. 14A-14C, the mutual engagement members include at least one pressing member 19 carried by the second ring 2, configured to cooperate with a respective seat 21 arranged at a portion of the inner wall of the first ring 1. To cooperate with the seat 21 of the first ring 1, the pressing member 19 is arranged at a portion of the outer wall 22 of the second ring 2.

An embodiment example of the pressing member 19 is illustrated in FIG. 14C. In this embodiment, the pressing member 19 protrudes from the outer wall 22 of the second ring 2, along a direction perpendicular to the plane corresponding to the circumference of the ring A3. The pressing member 19 may include a spring 23 having a first end constrained to the outer wall 22 of the second ring 2 and a second end bearing a ball 24. The seat 21 of the first ring 1 has a rounded profile, so as to accommodate the ball 24 of the pressing member 19.

It will therefore be appreciated that, in accordance with the engagement members described above, in a resting condition of the ring A3, the spring 23 is in an extended configuration, and the ball 24 of the pressing member 19 is in contact with the seat 22 of the first ring 1, stably defining the closed loop configuration (shown in FIGS. 12 and 14A).

In the case where either the first or the second ring 1, 2 is rotated with respect to the other to achieve the open ring configuration (FIG. 13), the spring 23 of the pressing member 13 is in a compressed configuration since the ball 24, coming out of the seat 22, is in contact with the inner wall of the first ring 1.

Thanks to the mutual engagement members as described above, it is possible to maintain the closed loop configuration in a stable manner, thus allowing the objects engaged therein to be safely stored within the ring A3.

Of course, the mutual engagement members illustrated and described for the third embodiment of the key-ring A3 are only one embodiment example, since also other types of members (for example, those described above for the first and second embodiments of the ring A1, A2) can be used with the ring conformation A3 illustrated in FIGS. 12-14A.

In the following part of the present description, a further preferred embodiment of the invention will now be described in detail (FIG. 15), wherein the first and second rings 1, 2 are slidably mounted and radially superimposed relative to each other. In this case as well, the first ring 1 has a C-shaped cross-section, so as to define an inner wall within which the second ring 2 is slidably arranged. The second ring 2 has an outer wall 22 in contact with the inner wall of the first ring 1. It will therefore be appreciated that the first and second rings 1, 2 are provided side by side relative to each other.

The outer wall 22 of the first ring 1 comprises a plurality of seats 26 arranged spaced apart and with constant pitch relative to each other, along the ring circumference. The mutual engagement members include a first pressing member 25 located at one of the seats 26. The first pressing member 25 can be a sphere protruding from the outer wall 22. The first ring 1 comprises a plurality of auxiliary seats 27 arranged spaced apart and with constant pitch relative to each other, configured for selectively receiving the first pressing member 25, so as to lock the second ring 2 with respect to the second ring 1. It should be noted that two consecutive seats 26 of the second ring 2 are placed at a distance cut in half with respect to the distance between two consecutive auxiliary seats 27 of the first ring 1. The first pressing member 25 and the seats 27 are configured for providing multiple ring configurations in a stably manner, so as to locate the first ring 1 with respect to the second ring 2 (thus the two open sectors 3,4) in any position along the ring circumference. The mutual engagement members can comprise also a second pressing member located, along the circumference of the second ring 2, at an opposite position with respect to the first pressing member 25. However, the first and the second pressing member are not spaced from each other with an angle of 180°, but are spaced so that, for example in the open ring configuration (open sectors 3,4 superimposed), one between the first and second pressing member is disposed within a respective auxiliary seat 27 of the first ring 1, and the other between the first and the second pressing member is against the inner wall of the first ring 1—between two auxiliary seats 27—, so as to press the second ring 2 inwardly. The pressing members can be spheres protruding towards the first ring 1 and the seats 26,27 can be with a rounded profile for selectively receiving the first or the second pressing member. It should be noted that the outer wall of the second ring 2 has a series of seats 26 arranged to receive further pressing members or to arrange the first and second pressing members in different positions with respect to what is indicated above.

Thanks to the mutual engagement members as described above, is possible to maintain multiple ring configurations in a stably manner (also the closed ring configuration), allowing to safely store the objects engaged within the ring A3.

It will be evident from the above description how the key-ring according to the invention achieves a series of advantages:

- the ring has a constructively simple structure, and is not bulky,
- the ring is extremely simple to use and allows objects used therein to be stored with maximum safety.

Of course, the details of construction and the embodiments can be widely varied with respect to those described and illustrated, without thereby departing from the scope of the invention as defined by the claims that follow.

What is claimed is:

1. A key-ring comprising:

a first ring and a second ring slidably mounted on each other along a circumferential direction, wherein each of said first ring and said second ring includes a respective open sector, so that said first ring and said second ring are movable on each other between an open ring configuration wherein said open sectors are aligned, and a closed ring configuration wherein said open sectors are offset relative to each other; and mutual engagement members configured to define at least one of said open ring configuration or said closed ring configuration, wherein the first ring and the second ring are slidably mounted and axially superimposed relative to each other, and wherein said first ring has an upper wall coupled with a lower wall of the second ring, said mutual engagement members including a toothing formed along said lower wall, arranged for cooperating with a pair of elastic tabs arranged within a grove formed along said upper wall of the first ring.

2. A key-ring according to claim 1, wherein the first ring and the second ring are slidably mounted and radially superimposed relative to each other.

3. A key-ring according to claim 1, wherein said mutual engagement members are configured for locking the key-ring selectively with the open ring configuration and with the closed ring configuration.

4. A key-ring according to claim 1 wherein said first ring has an upper wall coupled with a lower wall of the second ring, wherein said upper wall includes a grooved portion, extending along a circumference of the first ring, configured for cooperating with a corresponding toothed portion formed on the lower wall of the second ring.

5. A key-ring according to claim 1 wherein said mutual engagement members include:

a spring extending within a seat formed along a portion of an upper wall of the first ring, and a bar portion projecting from a lower wall of the second ring and arranged within said seat on a prolongation of said spring, said bar portion being slidable within said seat, so as to cooperate with said spring.

6. A key-ring according to claim 5, wherein said seat has a first end wall in contact with said spring and a second end wall in contact with said bar portion, in such a way that, in a resting condition of the ring, said bar portion abuts against said second end wall, and said spring acts against a sliding of the bar portion within the seat, stably defining said closed ring configuration.

7. A key-ring according to claim 1, wherein said toothing and said pair of elastic tabs are configured to enable sliding in one direction only of the first ring and the second ring relative to each other, and to define open ring configuration or the closed ring configuration.

8. A key-ring according to claim 7, wherein said pair of elastic tabs are formed on an intermediate ring located within said groove, and protrude towards said toothing, defining a plurality of ratchet-guided teeth with inclined surfaces.

9. A key-ring according to claim 2, wherein said first ring has a C-shaped cross-section, so as to define an inner wall within which the second ring is slidably arranged.

10. A key-ring according to claim 2, wherein said second ring has an outer wall in contact with the inner wall of the first ring, and an inner wall having a ridged profile, so as to facilitate the grip of a user on said inner wall, for rotating the second ring with respect to the first ring.

11. A key-ring according to claim 2, wherein said mutual engagement members include at least one pressing member carried by the second ring, configured to cooperate with a seat arranged at a portion of the first ring.

12. A key-ring according to claim 11, wherein:

said second ring has an outer wall in contact with an inner wall of the first ring, said outer wall comprises a plurality of seats arranged spaced apart and with constant pitch relative to each other, along a ring circumference, said mutual engagement members comprise a first pressing member of the at least one pressing member located at one of the seats, said first ring comprises a plurality of auxiliary seats arranged spaced apart and with constant pitch relative to each other, configured for selectively receiving the first pressing member, so as to lock the first ring with respect to the second ring in any position along the ring circumference.

13. A key-ring according to claim 12, wherein:

said mutual engagement members comprise a second pressing member of the at least one pressing member located, along the circumference of the second ring, at an opposite position with respect to the first pressing member, wherein the first pressing member and the second pressing member are spaced so that one between the first pressing member and the second pressing member is disposed within a respective auxiliary seat of the first ring, and the other between the first pressing member and the second pressing member is against the inner wall of the first ring, so as to press the second ring inwardly.

* * * * *